US009085154B2

(12) United States Patent
Shimazaki

(10) Patent No.: US 9,085,154 B2
(45) Date of Patent: Jul. 21, 2015

(54) LIQUID DISCHARGING APPARATUS AND METHOD OF DISCHARGING LIQUID

(71) Applicant: SEIKO EPSON CORPORATION, Tokyo (JP)

(72) Inventor: Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/683,712

(22) Filed: Nov. 21, 2012

(65) Prior Publication Data

US 2013/0328965 A1 Dec. 12, 2013

Related U.S. Application Data

(62) Division of application No. 12/165,862, filed on Jul. 1, 2008.

(30) Foreign Application Priority Data

Jul. 2, 2007 (JP) ..... 2007-174305
Apr. 23, 2008 (JP) ..... 2008-113048

(51) Int. Cl.
*B41J 2/165* (2006.01)
*B41J 2/175* (2006.01)

(52) U.S. Cl.
CPC ..... *B41J 2/16505* (2013.01); *B41J 2/16508* (2013.01); *B41J 2/175* (2013.01); *B41J 2/17596* (2013.01)

(58) Field of Classification Search
None
See application file for complete search history.

(56) References Cited

U.S. PATENT DOCUMENTS

| | | | | |
|---|---|---|---|---|
| 4,450,454 | A | | 5/1984 | Koto |
| 4,609,925 | A | | 9/1986 | Nozu et al. |
| 4,751,529 | A | | 6/1988 | Elrod et al. |
| 5,121,141 | A | | 6/1992 | Hadimoglu et al. |
| 5,424,768 | A | * | 6/1995 | Dudek et al. ..... 347/29 |
| 5,446,486 | A | | 8/1995 | Reis |
| 5,943,073 | A | | 8/1999 | Otsuka et al. |
| 6,082,851 | A | | 7/2000 | Shihoh et al. |
| 6,174,052 | B1 | | 1/2001 | Eremity et al. |
| 6,309,056 | B1 | | 10/2001 | Sando et al. |
| 6,491,370 | B2 | | 12/2002 | Momose |

(Continued)

FOREIGN PATENT DOCUMENTS

| | | |
|---|---|---|
| CN | 1918007 | 2/2007 |
| JP | 57-090838 | 6/1982 |

(Continued)

OTHER PUBLICATIONS

U.S. Appl. No. 12/165,862, filed Jul. 7, 2010, Office Action.

(Continued)

*Primary Examiner* — Alejandro Valencia
(74) *Attorney, Agent, or Firm* — Workman Nydegger

(57) ABSTRACT

A liquid discharging apparatus, which discharges liquid from a nozzle of a liquid discharging head on the basis of data, includes a controller and a member. When the controller is in a standby state where the liquid is not discharged from the nozzle on the basis of the data or after the controller has received a power OFF instruction, the controller performs a drawing operation in which the liquid is drawn to a side opposite to a discharge direction in which the liquid is discharged so as to at least form a space at a distal end portion of the nozzle. After the controller has performed the drawing operation, the member covers an opening of the nozzle.

10 Claims, 15 Drawing Sheets

(56) References Cited

U.S. PATENT DOCUMENTS

| | | | | |
|---|---|---|---|---|
| 6,702,421 | B2 | 3/2004 | Inui et al. | |
| 6,871,925 | B2 | 3/2005 | Yamamoto et al. | |
| 7,370,922 | B2 | 5/2008 | Umeda | |
| 7,387,377 | B2 | 6/2008 | Yoshino et al. | |
| 7,422,313 | B2 | 9/2008 | Umeda et al. | |
| 7,458,666 | B2 | 12/2008 | Momose | |
| 7,588,300 | B2 | 9/2009 | Koga et al. | |
| 7,597,434 | B2 | 10/2009 | Nitta et al. | |
| 7,618,128 | B2 | 11/2009 | Mataki | |
| 7,661,803 | B2 | 2/2010 | Morgan et al. | |
| 7,677,690 | B2 | 3/2010 | Takatsuka | |
| 7,708,378 | B2 | 5/2010 | Katada | |
| 7,874,658 | B2 | 1/2011 | Yoshino et al. | |
| 2004/0252144 | A1 | 12/2004 | Higuchi et al. | |
| 2005/0146574 | A1 | 7/2005 | Adachi | |
| 2005/0248610 | A1* | 11/2005 | Kuo | 347/29 |
| 2005/0285913 | A1 | 12/2005 | Yoshino et al. | |
| 2006/0023029 | A1 | 2/2006 | Mataki | |
| 2006/0050112 | A1 | 3/2006 | Moynihan | |
| 2006/0061639 | A1 | 3/2006 | Yoshino et al. | |
| 2006/0176346 | A1 | 8/2006 | Momose | |
| 2006/0268025 | A1* | 11/2006 | Umeda | 347/6 |
| 2006/0284946 | A1 | 12/2006 | Miyazawa | |
| 2007/0085874 | A1 | 4/2007 | Shindo | |
| 2008/0136883 | A1 | 6/2008 | Yoshio et al. | |
| 2008/0218554 | A1* | 9/2008 | Inoue | 347/33 |

FOREIGN PATENT DOCUMENTS

| | | |
|---|---|---|
| JP | 63-168363 | 7/1988 |
| JP | 03-015135 | 2/1991 |
| JP | 4-053754 | 2/1992 |
| JP | 08/244252 | 9/1996 |
| JP | 11/240179 | 9/1999 |
| JP | 2000-289222 | 10/2000 |
| JP | 2004/216818 | 8/2004 |
| JP | 2004/230832 | 8/2004 |
| JP | 04/259564 | 9/2004 |
| JP | 2005/178290 | 7/2005 |
| JP | 2007-015285 | 1/2007 |
| JP | 2007/137026 | 6/2007 |
| JP | 09/254369 | 11/2009 |
| WO | 2005/070678 | 8/2005 |

OTHER PUBLICATIONS

U.S. Appl. No. 12/165,862, filed Nov. 26, 2010, Final Office Action.
U.S. Appl. No. 12/165,843, filed Sep. 2, 2011, Restriction Requirement.
U.S. Appl. No. 12/165,843, filed Nov. 1, 2011, Office Action.

* cited by examiner

LIQUID DISCHARGING APPARATUS AND METHOD OF DISCHARGING LIQUID

This application is a Division of application Ser. No. 12/165,862, filed Jul. 1, 2008, and is expressly incorporated herein by reference. The entire disclosure of Japanese Patent Application No. 2007-174305, filed Jul. 2, 2007 and Japanese Patent Application No. 2008-113048, filed Apr. 23, 2008, are expressly incorporated herein by reference.

BACKGROUND OF THE INVENTION

1. Technical Field

The present invention relates to a liquid discharging apparatus. More specifically, the present invention relates to a controller and a method of controlling the discharging apparatus.

2. Related Art

An ink jet printer is one example of a liquid discharging apparatus currently known in the art. Typically, ink jet printers perform a printing process by discharging a liquid ink from a plurality of nozzles of a head onto various types of medium, such as paper, cloth, or film.

Unfortunately, however, when the openings of the nozzles are exposed to the atmosphere, there is a possibility that moisture, which acts as a solvent of the ink, may evaporate at the distal end portions of the nozzles where the ink is exposed to the external air. As the ink evaporates, the ratio of dissolved matter, such as dye, or the ratio of solid matter, such as pigment, to the solvent of the ink may increases over time and, as a result, the ink present at the distal end portions of the nozzles may become thickened, with an increased viscosity. This thickening not only adversely affects the amount of ink discharged and the positions at which ink lands but also causes clogs in the nozzles when the ink becomes too thick.

For this reason, when a printing process is not performed in a relatively long period of time, such as when the printer is in a power OFF state or in a print standby state, the nozzle forming face of the head, where the nozzles are formed, is covered with a cap member in order to prevent thickening around ink surfaces.

In some instances, such as in the Japanese Patent No. JP-A-2004-230832, the cap member may have a substantially rectangular-parallelepiped-box shape, where one wall of the box that faces the head is removed. Then, when the cap member is pressed against the head, the four sides of the cap member are brought into contact with the nozzle forming face in order to form a gap between the cap member and the distal end edges of the nozzles. Thus, the nozzles are covered and shielded against the surrounding space.

In recent years, in order to reduce printing time, line head printers have been developed, wherein the recording head has a length that is equal to or greater than the width of the printing medium with a nozzle column of aligned nozzles formed thereon. During a printing process using the line head printer, the recording head is able to print an image on a medium which is transported in a printing direction relative to the recording head, while the recording head remains in a fixed position. In this manner, high-speed printing may be achieved.

In the case of the line head printer, because the overall length of the nozzle column of the head is long, it is also necessary to increase the overall length of the cap member that covers the nozzle column. One problem with this configuration, however, is that there are many technical problems, such as squashed nozzles, that need to be addressed in order to form the above described box-shaped cap member of a sufficient length. In addition, in order to elongate the nozzle column of the head, a plurality of head units are connected to form one head. In this case, there will be a step between the connecting portions of the head units, making it difficult to bring the cap member into close contact with the head.

In some situations, instead of using a box-shaped cap member, the openings of the nozzles are closed using a flat plate member, which has a shape that is simpler than the cap members currently known in the art, that is, the cap member operates by simply bringing the flat face of the flat plate member into close contact with the nozzle forming face. Furthermore, there is a need for a configuration that can work even when the cap member is not firmly brought into close contact with the head.

However, as the flat face of the flat plate member is brought into close contact with the nozzle forming face, because the liquid level of ink is positioned adjacent to the nozzle openings, there is a possibility that, when the flat plate member closely contacts the nozzle forming face, the flat face of the flat plate member may contact the ink and thereby break the menisci of ink. In addition, when the cap member does not closely contact the head, there has been a problem that ink in the nozzles of the head dries and then thickens.

BRIEF SUMMARY OF THE INVENTION

An advantage of some aspects of the invention is that it provides a liquid discharging apparatus and a method of discharging liquid, which are capable of sealing the openings of nozzles using a sealing member without breaking the menisci of liquid formed at the distal end portions of the nozzles. In addition, aspects of the invention enable the usage of a cap that adheres less strongly to the head. [0012] An aspect of the invention provides a liquid discharging apparatus which discharges liquid from at least one nozzle of a liquid discharging head on the basis of data, which includes a controller and a member. When the controller is in a standby state where the liquid is not being discharged from the at least one nozzle on the basis of the data or after the controller has received a power OFF instruction, the controller performs a drawing operation wherein the liquid is drawn into the nozzle in a direction that is opposite to the discharge direction in order to form a space at a distal end portion of the at least one nozzle where no liquid is present. After the controller has performed the drawing operation, the member covers an opening of the at least one nozzle.

Other aspects of the invention will become apparent from the specification and the accompanying drawings.

BRIEF DESCRIPTION OF THE DRAWINGS

The invention will be described with reference to the accompanying drawings, wherein like numbers reference like elements.

FIG. 13 is a flow chart of processes that are performed after the power is turned on;

DESCRIPTION OF EXEMPLARY EMBODIMENTS

According to the description in the specification and the accompanying drawings, at least the following aspects will become apparent.

The liquid discharging apparatus will be described using an ink jet printer as an example of a liquid discharging apparatus capable of performing aspects of the invention. More particularly, the structure and processes of a line head printer (hereinafter, simply referred to as a printer 1) will be described as an example of an ink jet printer capable of performing aspects of the invention.

Configuration of Printing System 100

An embodiment of a printing system 100 that uses a liquid discharging apparatus capable of performing aspects of the invention will be described with reference to the accompanying drawings.

Figure 1:
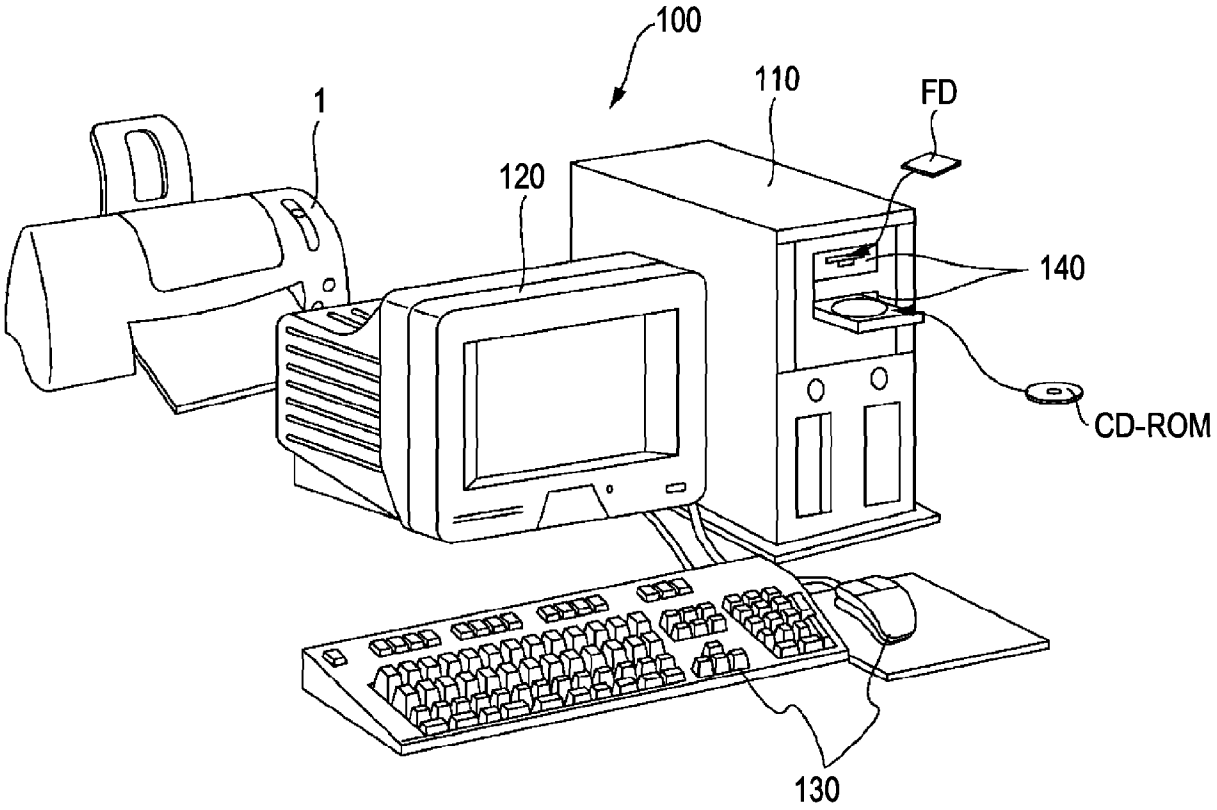
FIG. 1 is an external view that illustrates the configuration of a printing system.

FIG. 1 is an external view that illustrates the configuration of the printing system 100. The printing system 100 includes a printer 1, which serves as the liquid discharging apparatus, a computer 110, a display device 120, an input device 130 and a record reproducing device 140. The printer 1 is an ink jet printer that prints out an image by discharging ink droplets toward a medium, such as paper or cloth. The computer 110 is connected communicably with the printer 1. The computer 110 outputs print data corresponding to an image to be printed. The print data causes the printer 1 to print out the image. A printer driver is installed in the computer 110. The printer driver is a program for converting image data, which is output from an application program, into print data.

Figure 2:
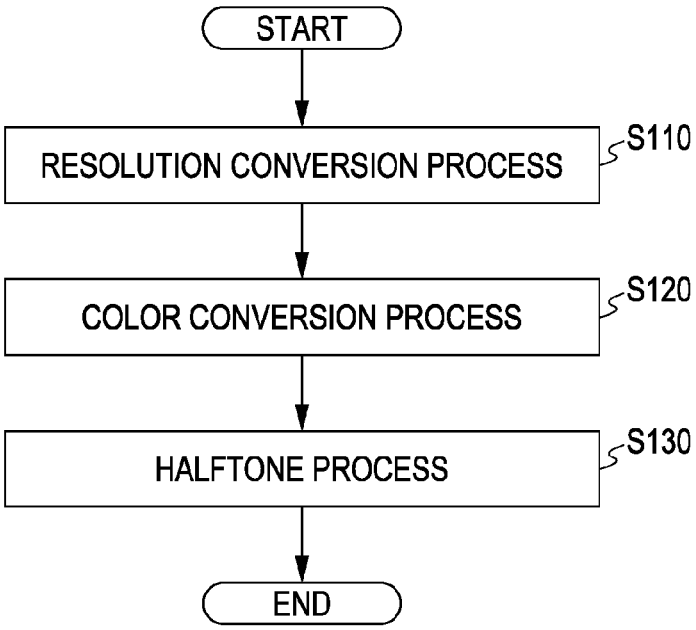
FIG. 2 is a flow chart that shows various processes executed by a printer driver.

FIG. 2 is a flow chart that shows various processes executed by the printer driver. The printer driver receives image data from an application program, converts the image data into print data in a format that can be interpreted by the printer 1, and then outputs the print data to the printer 1. When the image data from the application program is converted into print data, the printer driver performs a resolution conversion process, a color conversion process, and a halftone process, as shown in FIG. 2.

During the resolution conversion process (S110), image data (text data, image data, or the like), which has been output from the application program, is converted into a printing resolution (for example, 1600 dpi×1600 dpi) at which the image data is printed on a sheet of paper. Note that each pixel of image data, acquired after the resolution conversion process, is RGB data of multi-levels of gray scale (for example, 256 levels of gray scale) that are represented by RGB color space.

During the color conversion process (S120), the RGB data are converted into CMYK data that are represented by CMYK color space by referring to a color conversion look-up table. Note that pixel data that is acquired after the color conversion process is CMYK data of 256 levels of gray scale, represented by CMYK color space.

During the halftone process (S130), the data of high levels of gray scale are converted into data of low levels of gray scale that can be formed by the printer 1. Print data, which is the image data on which the halftone process has been executed, have a resolution equivalent to the above described printing resolution (for example, 1600 dpi×1600 dpi). In the image data (print data) acquired after the halftone process, each piece of pixel data is associated with each pixel of the image to be printed. Thus, each piece of pixel data indicates the status of dot formed in each pixel, such as whether or not a dot is present, the size of dot, or the like.

The print data generated through the above described resolution conversion process, color conversion process and halftone process, is then transmitted to the printer 1 by the printer driver.

Configuration of Printer 1

Configuration of Ink Jet Printer 1

Figure 3:
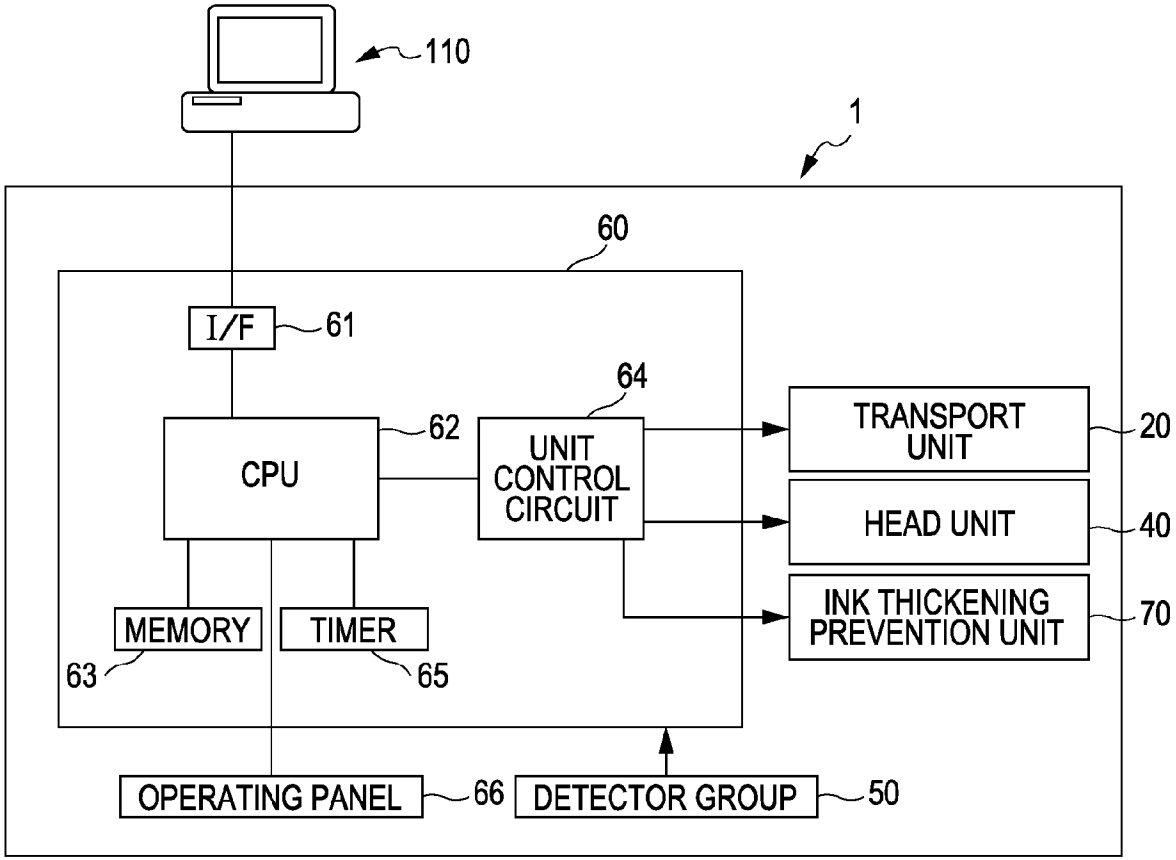
FIG. 3 is a block diagram of the general configuration of a printer.
Figure 4:
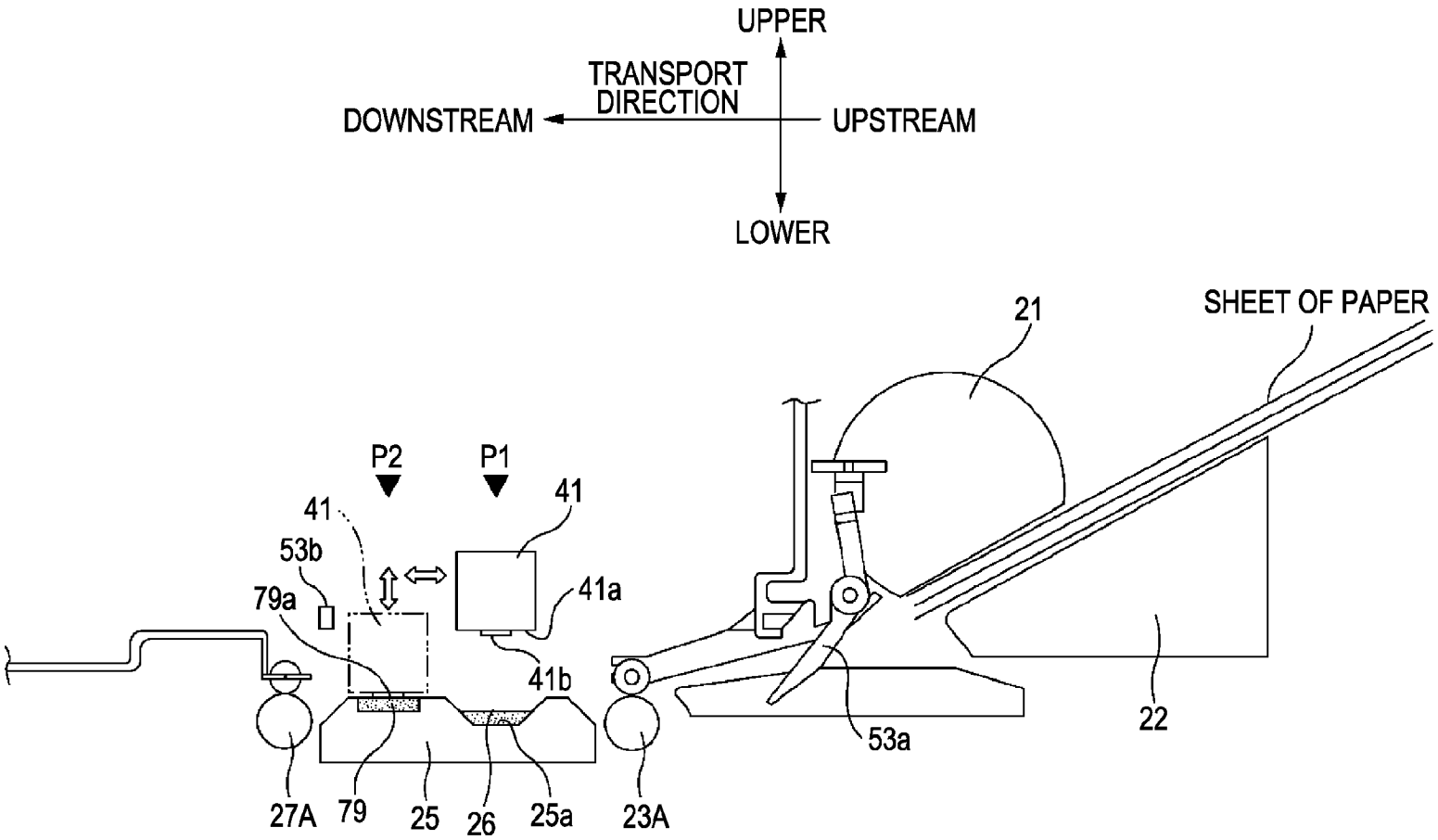
FIG. 4 is a longitudinal cross-sectional view of the printer.

FIG. 3 is a block diagram of the general configuration of the printer 1. FIG. 4 is a longitudinal cross-sectional view of the printer 1. As shown in FIG. 3, the printer 1 includes a transport unit 20, a head unit 40, an ink thickening prevention unit 70, a detector group 50, an operating panel 66, and a controller 60. When the printer 1 receives print data from the computer 110, the printer 1 controls various units (the transport unit 20, the head unit 40, and the like) using the controller 60. That is, the controller 60 controls various units based on the received print data transmitted from the computer 110 and then prints out an image on a sheet of paper. The internal status of the printer 1 is monitored by the detector group 50. The detector group 50 outputs detection results to the controller 60. The controller 60 controls various units based on the detection result output from the detector group 50.

Transport Unit 20

The transport unit 20, which may be regarded as a transport mechanism, is used to transport a sheet of paper in a transport direction. As shown in FIG. 4, the transport unit 20 includes, from the upstream side to the downstream side in the transport direction, a paper feed roller 21, a transport roller 23A, a platen 25, and a paper ejection roller 27A. The paper feed roller 21 is a roller that feeds a sheet of paper, contained in a paper feed tray 22, into the printer 1. The paper feed roller 21 is driven for rotation by a paper feed motor (not shown) comprising a DC motor. The transport roller 23A is used to transport the paper received from the paper feed roller 21 toward the platen 25 that is located downstream in the transport direction. The transport roller 23A is rotatably driven by a transport motor (not shown), which also comprises a DC motor.

The platen 25 is a support member that is arranged between the transport roller 23A and the paper ejection roller 27A in order to support a sheet of paper from its bottom surface during printing. The platen 25 is provided so as to face nozzles of the lower face 41*a* of a recording head 41. Note that a recess 25*a* is formed on the upper face of the platen 25, and an ink absorbent 26 is arranged on the bottom face of the recess 25*a*. The ink absorbent 26 is used to, for example, receive and hold ink that is discharged from the nozzles of the print head 41 during a nozzle flushing process or receive and hold ink that is wastefully discharged toward the area of a sheet of paper during borderless printing. The paper ejection roller 27A is a roller that further transports the sheet of paper, on which printing has been performed, toward the downstream side and ejects the sheet of paper to the outside of the printer 1. The paper ejection roller 27A is also coupled to the transport motor through an appropriate gear train and is rotatably driven by the transport motor.

Head Unit 40

The head unit 40 is used to discharge ink droplets on a sheet of paper. The head unit 40 has the recording head 41. A plurality of nozzles that discharge ink droplets are provided on the lower face 41*a* of the recording head 41 which is opposite to the platen 25. Then, dots are formed on the sheet of paper by discharging ink droplets from the nozzles onto the sheet of paper while the sheet of paper is being transported beneath the recording head 41. In this manner, an image is printed on the sheet of paper. The configuration of the recording head 41 will be described more fully below.

Ink Thickening Prevention Unit 70

The ink thickening prevention unit 70 is used to suppress the occurrence of thickened ink inside the nozzles of the recording head 41. The ink thickening prevention unit 70 has a nozzle opening sealing mechanism, and the like, which closely contact the nozzle forming face 41*b* of the print head 41 in order to seal nozzle openings Ne, as described more fully below.

Detector Group 50

The detector group 50 includes a rotary encoder (not shown), a first paper detection sensor 53*a*, a second paper detection sensor 53*b*, and the like, as shown in FIG. 4. The rotary encoder detects the amount by which the transport roller 23A is rotated or an amount by which the paper ejection roller 27A is rotated. Basis on this detection result, it is possible to detect the distance that a sheet of paper is transported. The first paper detection sensor 53*a* is used to detect the position of the front end of the sheet of paper during paper feeding. As shown in FIG. 4, the first paper detection sensor 53*a* is provided between the paper feed roller 21 and the transport roller 23A. The second paper detection sensor 53*b* is used to detect a position of the rear end of a sheet of paper as the paper is transported through the printer 1. The second paper detection sensor 53*b* is provided between the recording head 41 and the paper ejection roller 27A.

Operating Panel 66

The operating panel 66 is provided with various operating buttons, such as a power button. The power button is an ON/OFF switch that turns on or off the power of the printer 1. The power button is connected communicably through a signal line with the controller 60, which will be described more fully below. When the power button is pressed down, a power ON signal is transmitted to the controller 60. On the other hand, when the power button is pressed down again, a power OFF instruction is transmitted to the controller 60. After receiving the power OFF instruction, the controller 60 turns off the power of the printer 1.

Controller 60

The controller 60 is a control unit that controls the printer 1. The controller 60 includes an interface portion 61, a CPU 62, a memory 63, a unit control circuit 64, and a timer 65. The interface portion 61 transmits or receives data, such as print data, that is exchanged between the computer 110 and the printer 1. The CPU 62 is a processing unit that executes control over the printer 1. The memory 63 is used as an area that is capable of storing a program for the CPU 62 and executing the program, or the like. The memory 63 has a memory element, such as a RAM, an EEPROM, or the like. The CPU 62 controls various units through the unit control circuit 64 in accordance with the program stored in the memory 63. The timer 65 counts a period of time.

Recording Head 41

Figure 5:
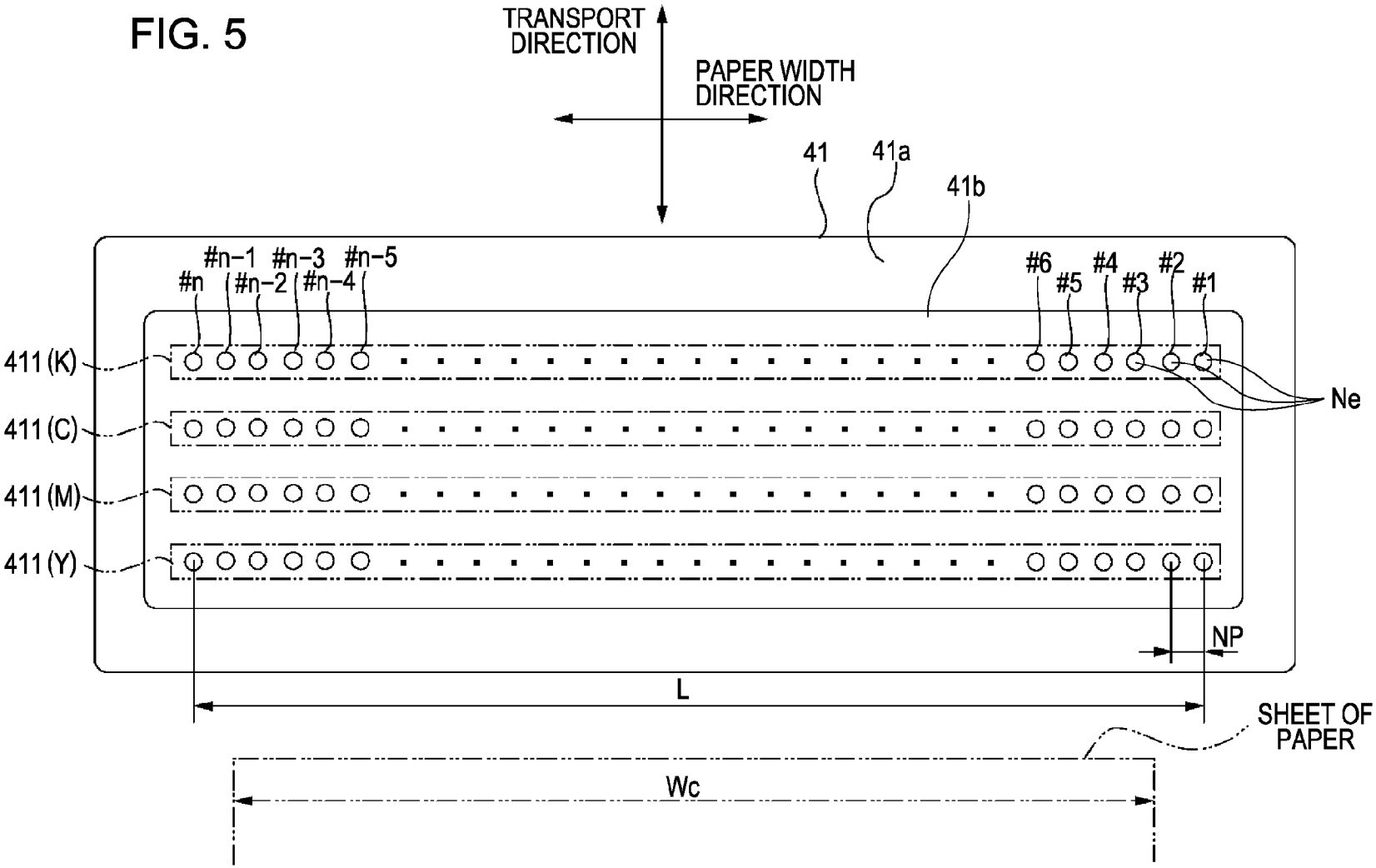
FIG. 5 is a view that illustrates a nozzle array provided on a lower face of a recording head.

FIG. 5 is a view that shows a nozzle array provided on the lower face 41*a* of the recording head 41. On the lower face 41*a* of the recording head 41, a plurality of nozzle columns 411 are formed at in a series of parallel lines which are separated from each other a predetermined distance in the transport direction, each of which is formed of a plurality of nozzles #1 to #n. The nozzle columns 411 correspond with colors of black (K), cyan (C), magenta (M), and yellow (Y). Note that the nozzle forming face 41*b* that surrounds the nozzle openings (distal end edges of the nozzles) Ne is a flat face that extends downward further from the lower face 41*a*, and the flat face is formed with an area that surrounds all the nozzle openings Ne.

The nozzles #1 to #n of each nozzle column 411 are arranged at a predetermined nozzle pitch P in a straight line that extends in the paper width direction, which is perpendicular to the transport direction of a sheet of paper. The nozzle pitch NP is determined based on the maximum value of the previously described printing resolution in the paper width direction. For example, when the maximum value of the printing resolution is 1600 dpi, the nozzle pitch NP is $1/1600$ inch. In addition, the overall length L of each nozzle column 411 in the paper width direction is longer than the maximum width We of a sheet of paper in the paper width direction. Thus, the recording head 41 of this embodiment is a so-called line head recording head 41. That is, when the recording head is stopped at a printing process position P1, as shown in FIG. 4, the recording head 41 performs a printing process by discharging ink droplets toward a sheet of paper that is transported from the upstream side in the transport direction.

Each of the nozzles #1 to #n is provided with a piezoelectric element (not shown), which serves as a driving element, that causes the ink to be discharged in the form of droplets. When each piezoelectric element is applied with a voltage between both electrodes provided at each end of the piezoelectric element for a predetermined period of time, the piezoelectric element expands. This causes the side wall of corresponding ink flow passage to be deformed. In this manner, the volume of each ink flow passage contracts in accordance with the expansion of each piezoelectric element, and ink corresponding to the amount of the contraction is discharged from each of the nozzles #1 to #n of each color in the form of ink droplets. Each piezoelectric element is driven based on each piece of pixel data of print data.

Figure 6:
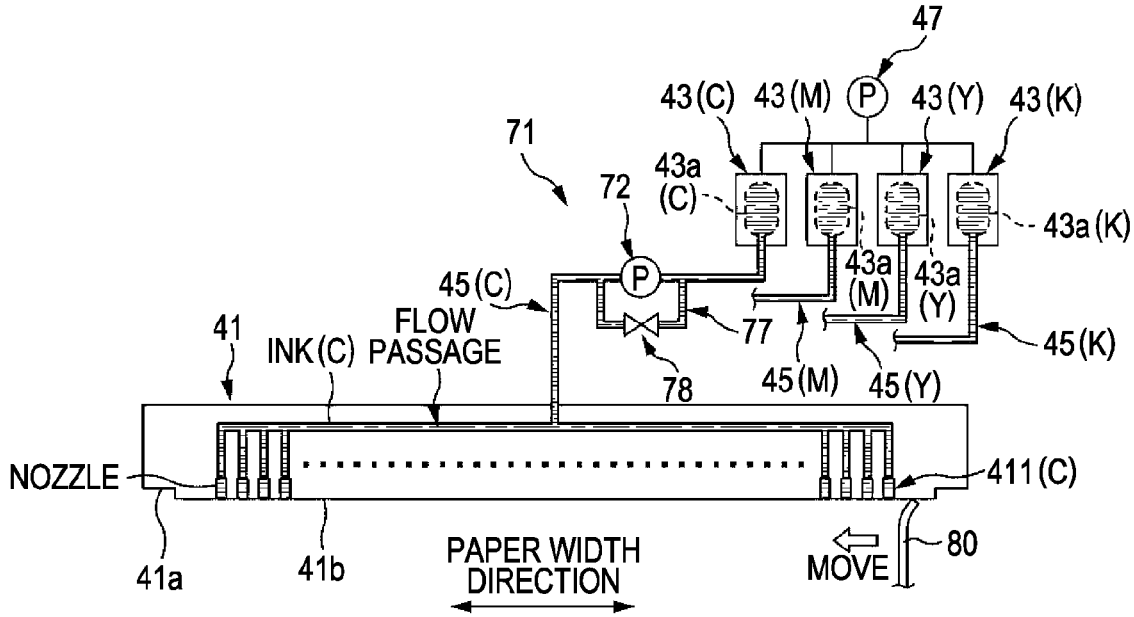
FIG. 6 is a schematic view of the ink supply to the recording head.

Ink is supplied to the recording head 41 from ink tanks 43 that are arranged inside the printer 1. That is, as is schematically shown in FIG. 6, the head unit 40 includes the ink tanks 43, each of which stores ink of a corresponding color. Ink of the corresponding color is supplied from the corresponding ink tank 43 to the nozzles in the recording head 41 through a corresponding supply tube 45, which may be regarded as flow passages. Specifically, an ink flow passage that is in fluid communication with each nozzle is formed inside the recording head 41 for each ink color, and the supply tube 45 is connected to the end of each flow passage adjacent to the ink tank 43. In this manner, ink in each ink tank 43 is supplied to the recording head 41.

In order to reliably supply ink, ink in each ink tank 43 is supplied under pressure. That is, the corresponding ink is contained in each ink tank 43 in such a manner that a sealed package 43*a* contains the ink, and the atmospheric pressure in the space surrounding the sealed package 43*a* in the ink tank 43 is applied with pressure by a pressure pump 47. Thus, each sealed package 43*a* is easily compressed by the pressure. Thus, ink in the sealed package 43*a* is pushed out to the supply tube 45, so that the ink is supplied to the recording head 41. Note that a pump 72 and a valve 78, shown in FIG. 6, are in connection with the ink thickening prevention unit 70 and will be described more fully below.

Printing Process

Figure 7:
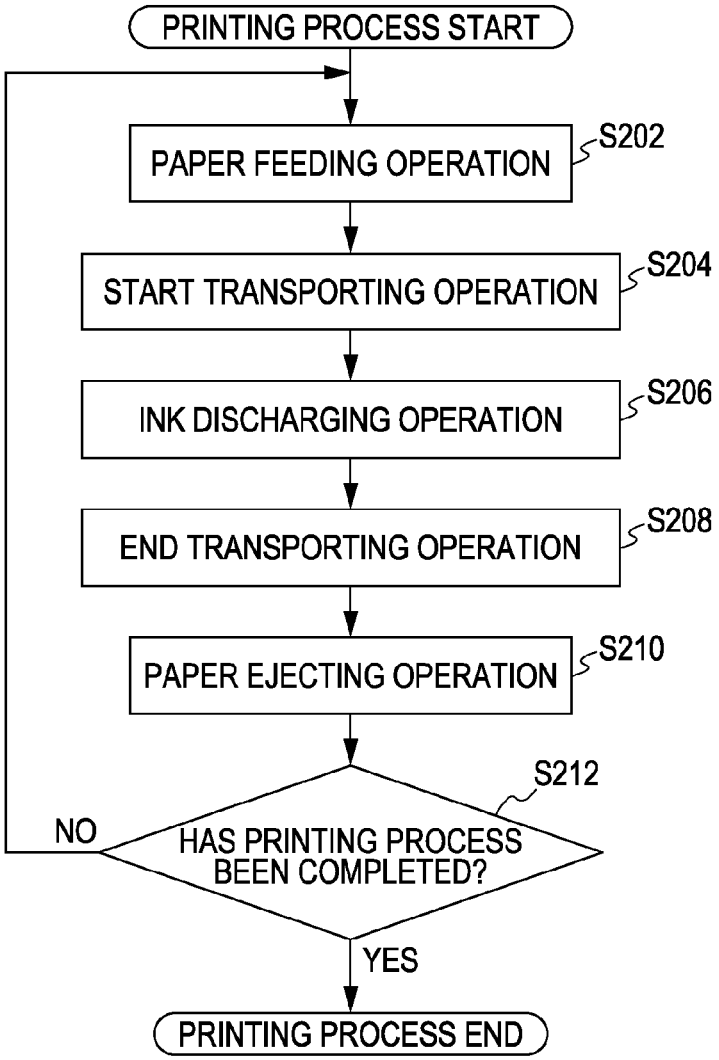
FIG. 7 is a flow chart of a printing process.

FIG. 7 is a flow chart of the printing process. Note that these operations may be performed in such a manner that the controller 60 controls various units in accordance with the program stored in the memory 63. The program includes codes for executing the operations. The printing process is executed when the controller 60 receives a print instruction that is transmitted from the computer 110. The print instruction is, for example, included in the header of print data transmitted from the computer 110. The controller 60 analyzes the content of various commands included in the received print data, and performs a paper feeding operation, transporting operation, ink discharging operation, and paper ejecting operation, using various units of the printer 1.

First, the controller 60 performs the paper feeding operation (S202), wherein the front end of a sheet of paper to be printed is transported to a predetermined print start position inside the printer 1. That is, the controller 60 drives the paper sheet of paper reaches the print start position, the controller 60 stops rotation of the transport motor. The print start position is a position that is, for example, located between the recording head 41 and the transport roller 23A, which does not face any one of the nozzles of the recording head 41. Thus, the front end of the sheet of paper arrives at the print start position and is detected by the first paper detection sensor 53*a*.

Next, the controller 60 starts the transporting operation (S204), wherein a sheet of paper is transported at a predetermined transport speed by the transport roller 23A (which is driven by the transport motor) toward the downstream side in the transport direction. Then, during the transporting operation, the ink discharging operation in which ink droplets are discharged from the recording head 41 is performed (S206). In the ink discharging operation, ink droplets are intermittently discharged from the nozzles of each nozzle column 411 based on the print data. As a result, a plurality of dots are formed on a sheet of paper so as to be aligned along the transport direction, and dots are formed at the nozzle pitch P of each nozzle column 411 in the paper width direction. Note that the ink discharging operation ends when there is no other piece of data to be printed on a sheet of paper during the printing process. [0056] When the rear end of the sheet of paper reaches a paper ejection start position located on the downstream side of the recording head 41, the transporting operation ends (S208) and the paper ejecting operation is performed (S210). The paper ejecting operation is an operation wherein a sheet of paper is transported to the downstream side at a speed that is higher than the transport speed of the transporting operation by the paper ejection roller 27A driven by the transport motor. Thus, the sheet of paper is ejected to the outside of the printer 1 at a high speed. During this process, the arrival of the rear end of the sheet of paper at the paper ejection start position is detected by the second paper detection sensor 53*b*.

Then, the controller 60 determines whether the printing process should be continued (S212) to another sheet of paper. When it is determined that printing will be performed on the next sheet of paper, the controller 60 returns the process to the above described step 5202 and then starts the paper feeding operation (S202) for the next sheet of paper. When it is determined that printing will not be performed on another sheet of paper, the controller 60 completes the printing process. Note that the above determination is made, for example, based on whether there is still data to be printed in the print data.

The ink thickening prevention process will now be described.

Ink Thickening Prevention Process

Figure 8A:
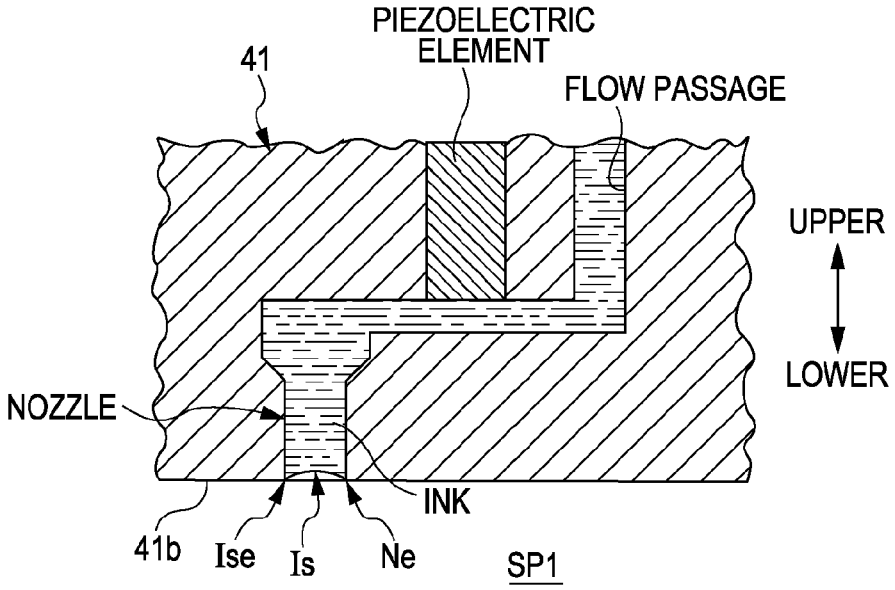
FIG. 8A is an enlarged longitudinal cross-sectional view of a portion around a nozzle, illustrating the thickened ink that may occur around the distal end portion of the nozzle of the recording head.

FIG. 8A is an enlarged longitudinal cross-sectional view of the area around a nozzle, which illustrates the thickening of ink that may occur around the distal end portion of the nozzle of the recording head 41.

During the print standby state of printers currently known in the art, when a printing process is not being performed or in the power OFF state, the flow passages inside the recording head 41 are filled with ink, and a meniscus Is which comprises the end of the flow of ink on the discharge side, reaches each nozzle opening Ne, which is the distal end edge of each nozzle. Thus, each ink surface Is is exposed to the atmosphere. This means that moisture, which is a solvent in the ink, may easily evaporate from each ink surface Is. As a result, the ratio of dissolved matter, such as dye, or the ratio of solid matter, such as pigment, in the ink may increase over time around the nozzle openings Ne and, hence, the ink around the nozzle openings Ne may become thickened. This thickening not only adversely affects the amount of ink discharged and the positions at which ink lands but also causes nozzle clogging when ink is excessively thickened.

For this reason, in order for the nozzle openings Ne not to be exposed to the atmosphere SP1, the nozzle forming face 41*b*, on which the nozzle openings Ne are formed, is covered with a sealing member. Typically, the sealing member generally employs a box-shaped member, the upper face of which is open, having a bottom at one end. One problem with this configuration, however, is that the box-shaped member may become deformed, resulting in increased occurrences of squashed nozzles. Thus, in the printer 1 uses a flat plate member 79, shown in FIG. 8B, as the sealing member. That is, by bringing the flat sealing face 79*a* of the flat plate member 79 into close contact with the flat nozzle forming face 41*b* of the print head 41, the nozzle forming face 41*b* of the print head 41 is covered. In this manner, the nozzle openings Ne are sealed. The flat plate member (sealing member) 79 according to the present embodiment is an example of a member that covers the nozzle openings Ne.

However, as described above, the outer peripheral edge Ise of each ink surface Is may reach the nozzle opening Ne, such that when the sealing face 79*a* of the flat plate member 79 is brought into close contact with the nozzle forming face 41*b*, the outer peripheral edge Ise of each ink surface Is contacts the sealing face 79*a*. Thus, there is a possibility that the meniscus of each ink surface Is may be broken and, hence, the ink may flow out onto the sealing face 79*a*.

Figure 9:
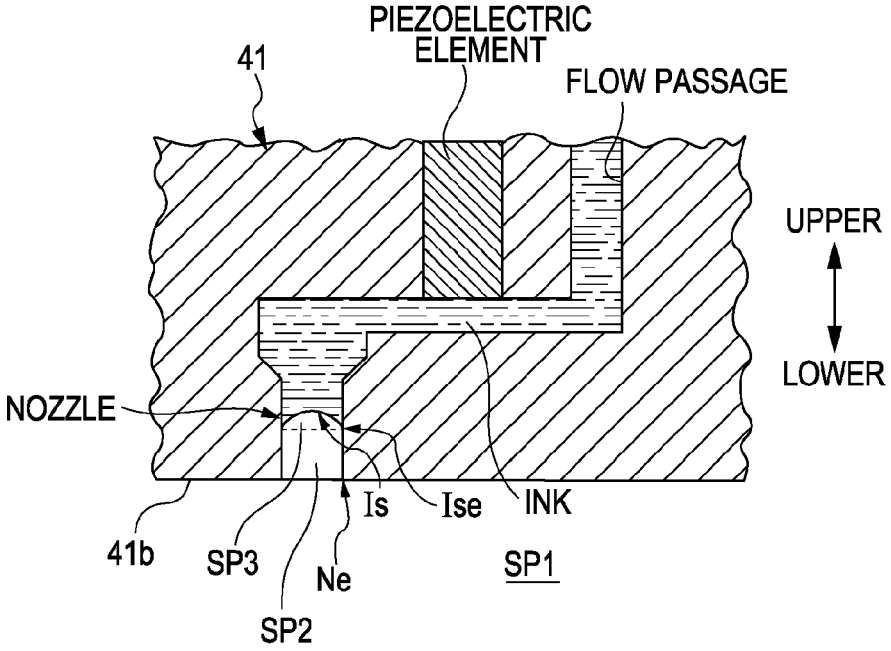
FIG. 9 is a view that illustrates a method of preventing the ink from thickening.

Then, in the printer 1, before the sealing face 79*a* of the flat plate member 79 seals the nozzle openings Ne, the ink is drawn into the nozzle in a non-discharge direction or non-discharge side, which is opposite to the direction in which the ink is discharged herein referred to as the discharge direction, so as to form a space SP2 at the distal end portion of each nozzle, as shown in FIG. 9. In this manner, the sealing face 79*a* (not shown in FIG. 9) of the flat plate member 79 is prevented from contacting the ink surfaces Is.

Incidentally, here, the wording the space SP2 is formed at the distal end portion of each nozzle" means that, a space SP2 is formed in addition to a concave recess SP3 owing to the meniscus of ink. Thus, when the space SP2 has been formed, the outer peripheral edge Ise of each ink surface Is is positioned toward the non-discharge side of the nozzle opening Ne. In other words, the entire ink surface Is is positioned on the non-discharge side of the nozzle opening Ne.

The ink thickening prevention process of the above concept may be, for example, an "ink retraction process" and an "ink recovery process".

Figure 8B:
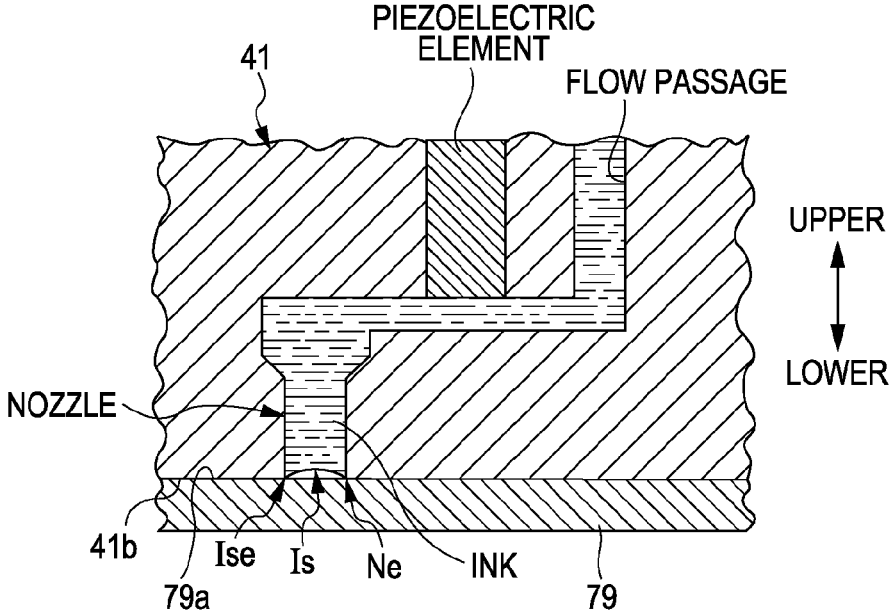
FIG. 8B is an enlarged longitudinal cross-sectional view of a portion around a nozzle, illustrating a problem that arises when the thickening is prevented by a flat plate member.
Figure 10A:
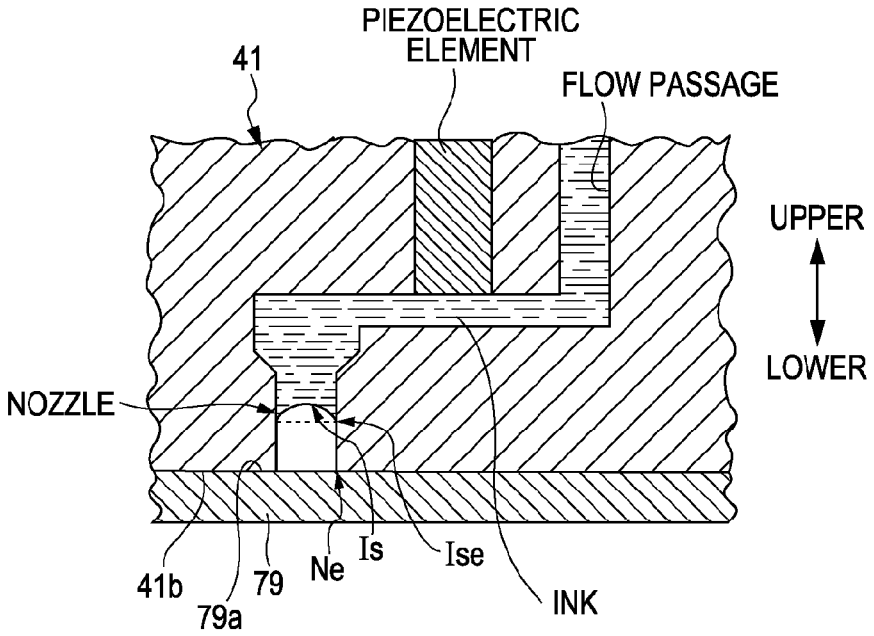
FIG. 10A is a view that illustrates an ink retraction and sealing process.

In the ink retraction process, as shown in FIG. 10A, ink is drawn toward the non-discharge side. Here, the nozzle openings Ne are sealed by the flat plate member 79. Here, the nozzle means comprises a portion of the flow passage that is continuous with form of a straight tube such that no bent portion is formed therein and the same cross-sectional shape is maintained from the nozzle opening Ne along the direction of the normal line of the open face of each nozzle opening Ne. In addition, the nozzle is formed on the discharge side of the previously described piezoelectric element, shown in FIG. 10A. Then, according to the ink retraction process, because the position of each drawn ink surface Is is located inside the nozzle, as shown in FIG. 9, each ink surface Is may be immediately returned to the position of the nozzle opening Ne, as shown in FIGS. 8A and 8B. That is, the nozzles may be immediately returned to a state in which the printing process may be performed. Thus, the ink retraction and sealing process is suitable for the case in which a printing process will not be performed again for a short period of time. In the printer 1, the ink retraction and sealing process is executed when the printer 1 is in the print standby state for a relatively short amount of time.

Figure 10B:
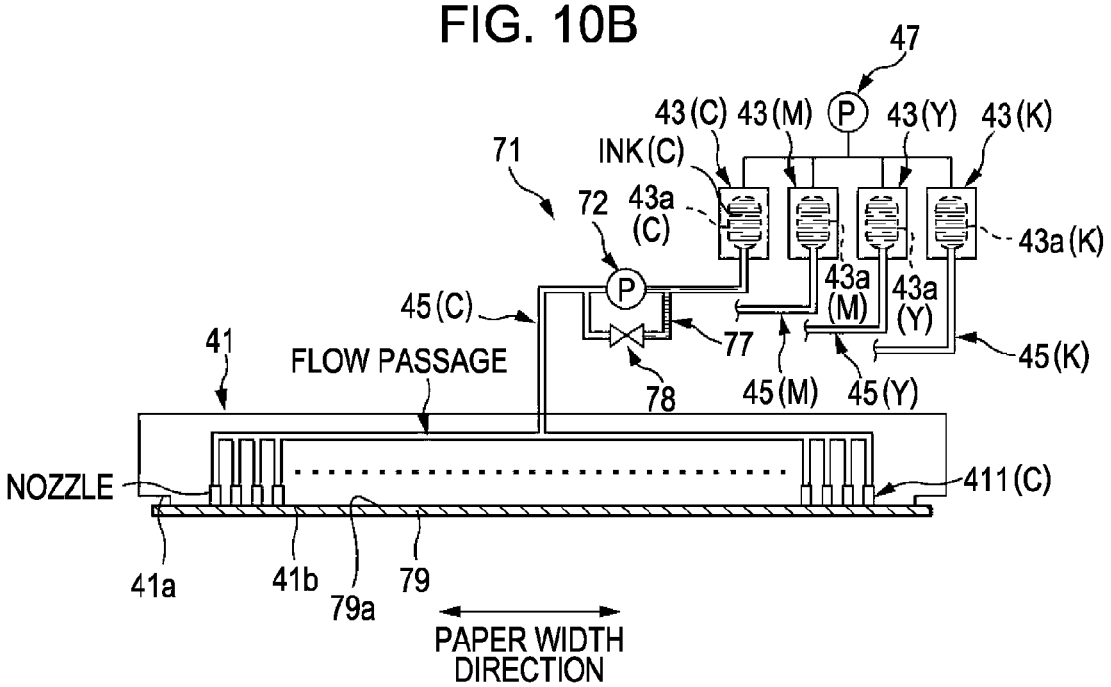
FIG. 10B is a view that illustrates an ink recovery and sealing process.

On the other hand, in the ink recovery and sealing process, as shown in FIG. 10B, almost all the ink that is present in the flow passages of the recording head 41 and in the supply tubes 45 is recovered into the ink tanks 43. Thus, the insides of the flow passages of the recording head 41 and the insides of the supply tubes 45 are emptied while the nozzle openings Ne are sealed by the flat plate member 79. Thus, according to the ink recovery process, it is possible to prevent evaporation of ink by the sealed package 43*a* of each ink tank 43 for a long period of time and, as a result, it is possible to prevent thickening of ink over a longer period of time than the above described ink retraction process.

However, when the ink recovery process is performed, it is necessary to refill the recording head 41 with ink inside each ink tank 43 (see FIG. 6) prior to the printing process. Therefore, it takes longer to return the nozzles to a state wherein the printing process may be performed. Thus, the ink recovery and sealing process is suitable for situations wherein the printing process will not be performed for a long period of time. In the printer 1, the ink recovery and sealing process are executed when the printer is in a power OFF state or in the print standby state for a relatively long period of time.

Ink Thickening Prevention Unit 70

The ink thickening prevention process is executed in such a manner that the controller 60 controls the ink thickening prevention unit 70. Each ink thickening prevention unit 70 includes a nozzle opening sealing mechanism and an ink drawing mechanism 71. The nozzle opening sealing mechanism seals the nozzle openings Ne of the print head 41. The ink drawing mechanism 71 draws ink toward the non-discharge side of the nozzles in order to form a space at the distal end portion of each nozzle. [0070] The nozzle opening sealing mechanism includes the above described flat plate member 79. As shown in FIG. 4, the flat plate member 79 is fitted into a recess formed on the upper face of the platen 25 downstream to the ink absorbent 26 in the transport direction at an orientation such that that the upper face 79*a* of the flat plate member 79 is exposed. The material of the flat plate member 79 may be, for example, an elastic body, such as CR rubber (chloroprene rubber) or EPDM (ethylene propylene dien rubber), a felt, or the like. In addition, the upper face 79*a* of the flat plate member 79 is a flat face that is parallel to the flat nozzle forming face 41*b* of the print head 41. Moreover, the area of the upper face 79*a* is set to a size large enough to cover all the nozzle openings Ne of the nozzle forming face 41*b*. Thus, when the upper face 79*a* of the flat plate member 79 is in close contact with the nozzle forming face 41*b*, the upper face 79*a* uniformly contacts a portion of the nozzle forming face 41*b* around the nozzle openings Ne. In this manner, the nozzle openings Ne are hermetically sealed so that close contact is ensured with the large nozzle forming face 41*b*.

Note that the nozzle opening sealing mechanism also includes a guide member and a driving mechanism, which are not shown in the drawings. Using the guide member and driving mechanism, the print head 41 is movable horizontally between the printing process position P1, which is a position above the ink absorbent 26, and a print standby position P2, which is a position above the flat plate member 79, and is capable of moving towards or away from the platen 25, that is, is capable of moving vertically, at the latter print standby position P2.

Thus, when the nozzle openings Ne are sealed in during the print standby state after the printing process, the print head 41 moves horizontally from the printing process position P1 to the print standby position P2. Then, the print head 21 is lowered until the nozzle forming face 41*b* closely contacts the upper face 79*a* of the flat plate member 79. On the other hand, when the sealed state of the nozzle openings Ne is ended in order to switch from the print standby state to the printing process, the print head 41 is raised to separate the nozzle forming face 41*b* from the flat plate member 79 and, after that, moves horizontally from the print standby position P2 to the printing process position P1. Note that the guide member may employ an appropriate rail, or the like, and the driving mechanism may employ an appropriate mechanism, or the like, that transmits the driving force of a motor through a cam, gear, or the like, to the print head 41.

Each ink drawing mechanism 71, as shown in FIG. 6 and FIG. 10B, includes a tube pump 72, a bypass tube 77, and a bypass valve 78. The tube pump 72 is provided in the supply tube 45 for supplying ink in the ink tank 43 to the recording head 41. The bypass tube 77 bypasses the tube pump 72. The bypass valve 78 opens or closes the flow through the bypass tube 77. Note that the ink thickening prevention unit 70 is provided for each of the colors of ink (collectively referred to as CMYK), that is, for each of the supply tubes 45 of CMYK inks.

Figure 11A:
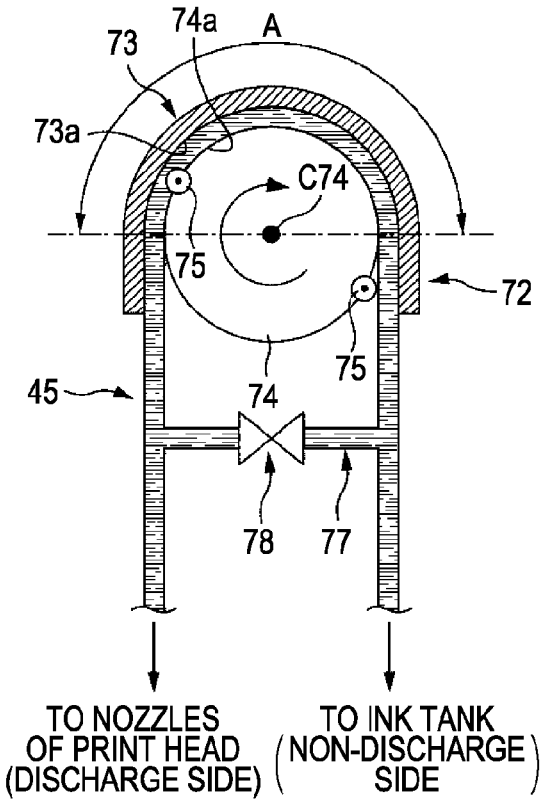
FIGS. 11A-11B illustrate a tube pump.
Figure 11B:
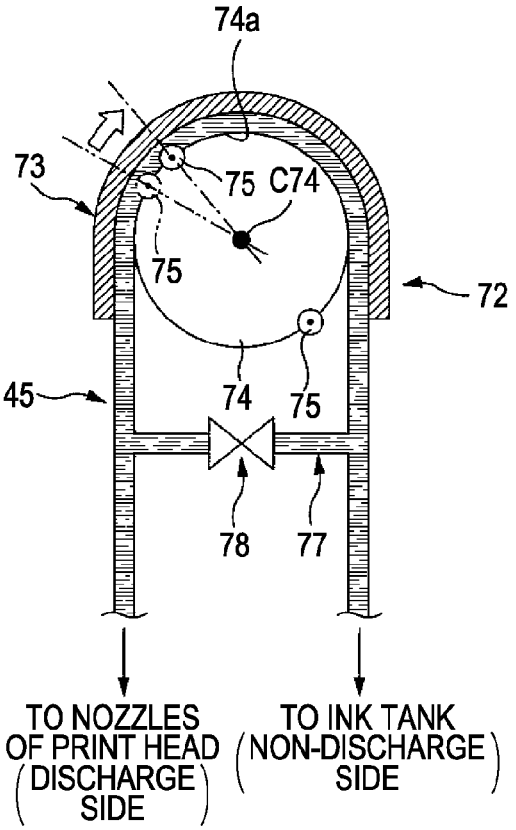

FIG. 11A and FIG. 11B are partial cross-sectional views, each of which illustrate the tube pump 72. The tube pump 72 repeatedly compresses a predetermined range A of the supply tube 45 in order to feed ink in a press direction. Specifically, the tube pump 72, as shown in FIG. 11A, includes a case 73, a rotary disk 74, a pair of press rollers 75, and a drive motor (not shown). The rotary disk 74 is disposed in the case 73 and is rotatable about a center C74. The pair of press rollers 75 protrude outward from the outer peripheral face of the rotary disk 74 and are rotatable about a point. The drive motor rotatably drives the rotary disk 74. In addition, the supply tube 45 is arranged between the inner wall face 73*a* of the case 73 and the outer peripheral face 74*a* of the rotary disk 74. Thus, as the rotary disk 74 is rotated by the drive motor, a portion of the supply tube 45, which is in contact with the press roller 75, is pressed between the press roller 75 and the inner wall face 73*a* of the case 73. In this manner, ink is moved in the press direction. After this process, the portion pressed returns to an original swelled shape because of a self-restoring force based on elasticity of the supply tube 45. At this time, ink that is present on a side opposite in the press direction is drawn up. Thus, as the rotary disk 74 is rotated in one direction, ink in the supply tube 45 may be fed in a direction along the rotation direction of the rotary disk 74. When ink is fed by the tube pump 72, the bypass valve 78 is, of course, closed. [0075] According to the above ink thickening prevention unit 70, it is possible to execute the above described ink retraction process and ink recovery process in the following manner. In the ink retraction process, as described with reference to FIG. 9, because the ink is drawn in toward the non-discharge side by a small amount to the extent that the position of each ink surface Is is located inside the nozzle, as shown in FIG. 11B, the rotary disk 74 rotates in the non-discharge direction by a rotational angle (for example, 10 degrees) corresponding to the small amount and then stops in that state.

Then, the supply tube 45 is pressed by a portion of perimeter corresponding to the rotational angle and thereby ink is fed in the non-discharge direction. Following this process, the pressed portion of the supply tube 45 returns to an original swelled shape because of a self-restoring force based on the self-elasticity. Thus, a suction force occurs in the supply tube 45 in the non-discharge direction and, hence, ink at the distal end portion of each nozzle is drawn to the extent that the ink surface Is is located inside the nozzle. Thereafter, the rotary disk 74 is not rotated and is maintained at that stopped state, so that the drawn position of each ink surface Is is maintained.

Then, the print head 41, which is positioned the printing process position P1 shown in FIG. 4, moves horizontally in the transport direction to the print standby position P2, wherein the print head 41 faces the flat plate member 79. Then, the print head 41 is lowered to bring the nozzle forming face 41*b* of the print head 41 into close contact with the upper face 79*a* of the flat plate member 79. In this manner, the nozzle openings Ne are sealed.

Note that, when the ink retraction and sealing process is executed, it is necessary to return the print head 41 to a state wherein printing may be performed. The process to return the print head 41 is termed "reposition process". In the reposition process, a reverse process of the above described ink retraction and sealing process is performed. That is, as shown in FIG. 4, the position of the print head 41 is returned from the print standby position P2 to the printing process position P1, and, as shown in FIG. 8A, the position of each ink surface Is returned to the nozzle opening Ne (distal end edge of the nozzle), as shown in FIG. 4. Then, the print head 41, which is located at the print standby position P2, is raised to be separated from the flat plate member 79. Thus, the sealed state of the nozzle openings Ne is terminated. The returning process (hereinafter, referred to as ink absorbent 26. Thereafter, as shown in FIG. 8A, the process of repositioning the ink surface Is in the nozzle to the nozzle opening Ne (distal end edge of the nozzle) is performed. This process is performed by opening the bypass valve 78 shown in FIG. 11B. That is, as the bypass valve 78 is opened, ink in the ink tank 43 is fed through the bypass tube 77 to the side of the nozzles without passing through the tube pump 72. In this manner, the ink surface Is returns to the nozzle opening Ne shown in FIG. 8A. In this manner, the print head 41 returns to a state in which printing may be performed.

On the other hand, in the ink recovery process, as is described with reference to FIG. 9B, all the ink that is present in the flow passages of the recording head 41 and in the supply tubes 45 is recovered by transferring the ink to the ink tanks 43. Thus the rotary disk 74 shown in FIG. 11A continuously rotates in the non-discharge direction a number of rotations that correspond to the amount of the entire ink to be recovered and, thereafter, stops rotation. Then, during the above continuous rotation, the predetermined range A of each supply tube 45 is repeatedly and sequentially compressed by the pair of press rollers 75. Then, the pressed portion expands again and again because of a self-restoring force that occurs every time the supply tube 45 is pressed. In this manner, the insides of the flow passages of the recording head 41 and the insides of the supply tubes 45 are emptied.

Then, as in the case of the above described ink retraction and sealing process, the print head 41, which is located at the printing process position P1 shown in FIG. 4 moves horizontally to the print standby position P in the transport direction, and, at that position, the print head 41 is lowered to bring the nozzle forming face 41*b* of the print head 41 into close contact with the upper face 79*a* of the flat plate member 79. In this manner, the nozzle openings Ne are sealed.

Figure 13:
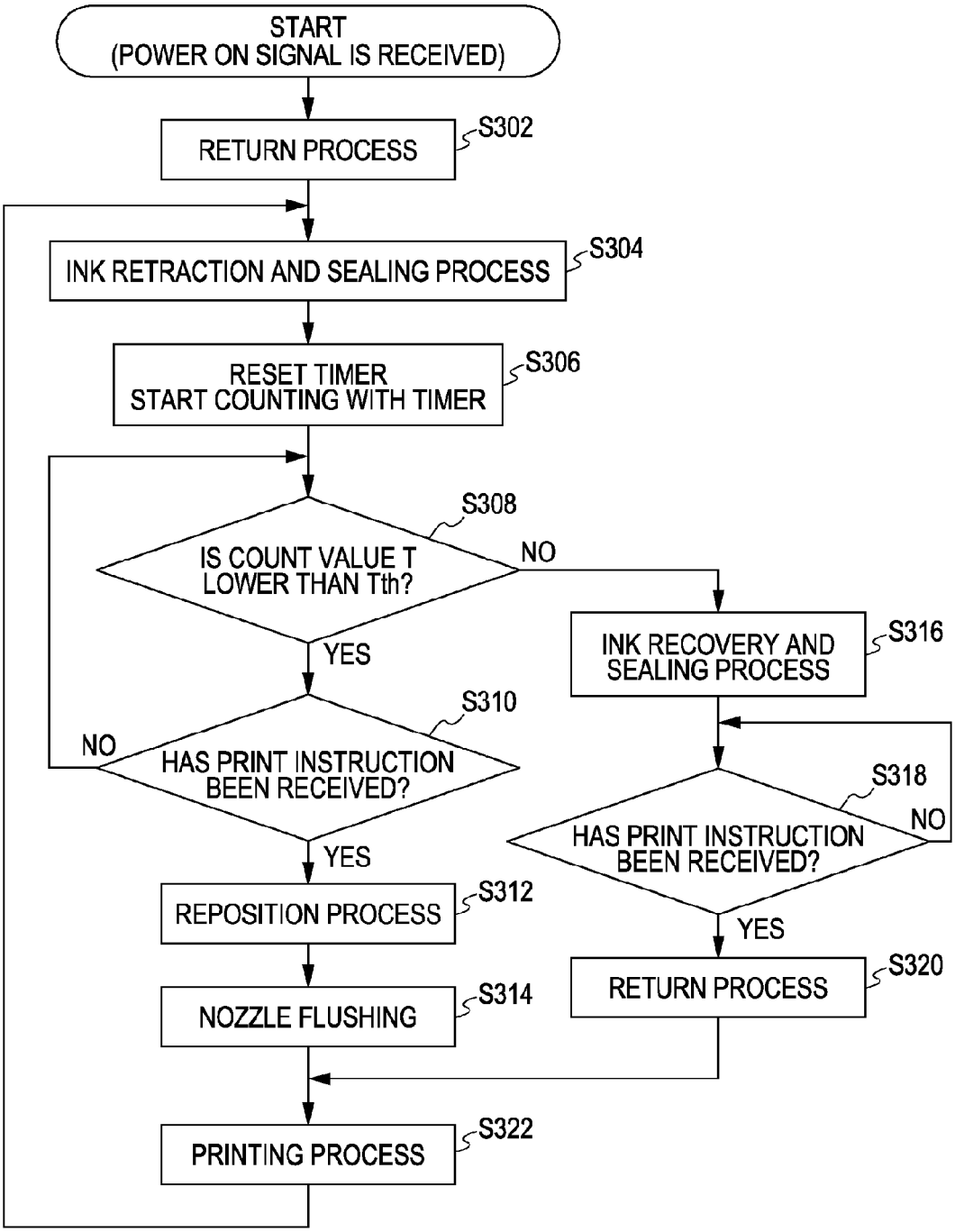

Note that, as shown in FIG. 13, which will be described more fully below, when the ink retraction and sealing process (S304) are executed prior to the ink recovery and sealing process (S316) and, therefore, the print head 41 is already located at the print standby position P2 before the ink recovery and sealing process (S316) starts, meaning that the step of moving the print head 41 to the print standby position P2 is, of course, omitted. In addition, in that case, the nozzle openings Ne of the print head 41 have been already sealed by the flat plate member 79 before the ink recovery and sealing process (S316) begins. Therefore, it may be difficult to recover ink into the ink tanks 43. In this case, for example, the print head 41 is once raised to release the sealing of the nozzle openings Ne, and the tube pumps 72 are operated to recover ink into the ink tanks 43. After that, the print head 41 is lowered to be brought into close contact with the upper face 79*a* of the flat plate member 79 again. The nozzle openings Ne may be sealed in this manner.

Incidentally, when the ink recovery and sealing process is performed, it is also necessary to return the print head 41 to a state wherein printing may be performed. This process to process (hereinafter referred to as ink return process". In the return process, first, the print head 41, which is located at the print standby position P2 shown in FIG. 4, is raised to be separated from the flat plate member 79. Thus, the sealing of the nozzle openings Ne is terminated. The print head 41 then horizontally moves and returns to the printing process position P1. Then, the process of filling the empty flow passages in the print head 41 and the empty supply tubes 45 with ink is performed. This process is achieved by rotating the rotary disk 74 in the reverse direction of the direction described above. That is, as shown in FIG. 11A, each rotary disk 74 is rotated in the discharge direction, similar to the above described manner, so that the ink in the corresponding ink tank 43 is drawn by the supply tube 45 based on the pump principle, and introduced into the flow passages of the recording head 41. Finally, the insides of the supply tubes 45 and the flow passages of the recording head 41 are filled with ink to the nozzle openings Ne. After that, a small amount of ink drips from the nozzle openings Ne, and, in this state, the rotary disk 74 is stopped.

Figure 12A:
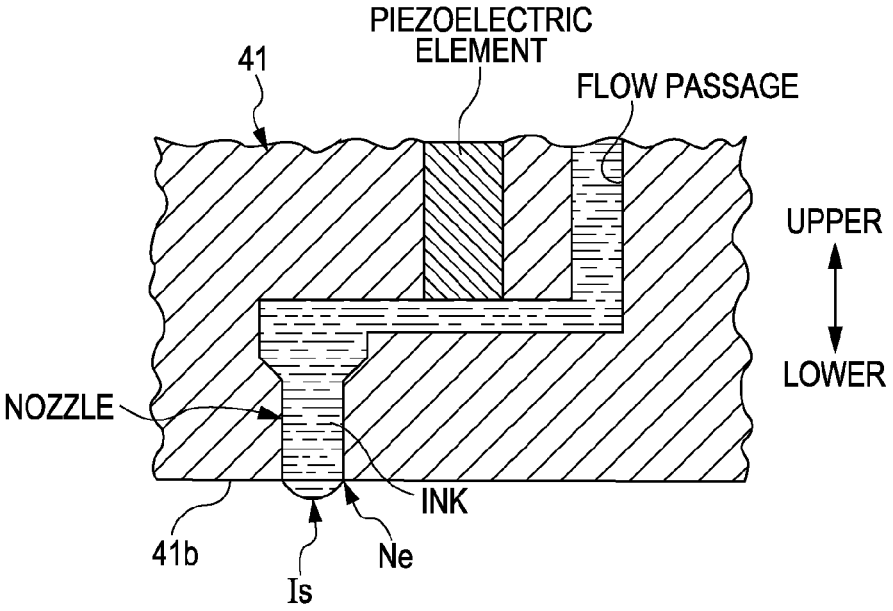
FIG. 12A-12B illustrates a convex meniscus of ink.
Figure 12B:
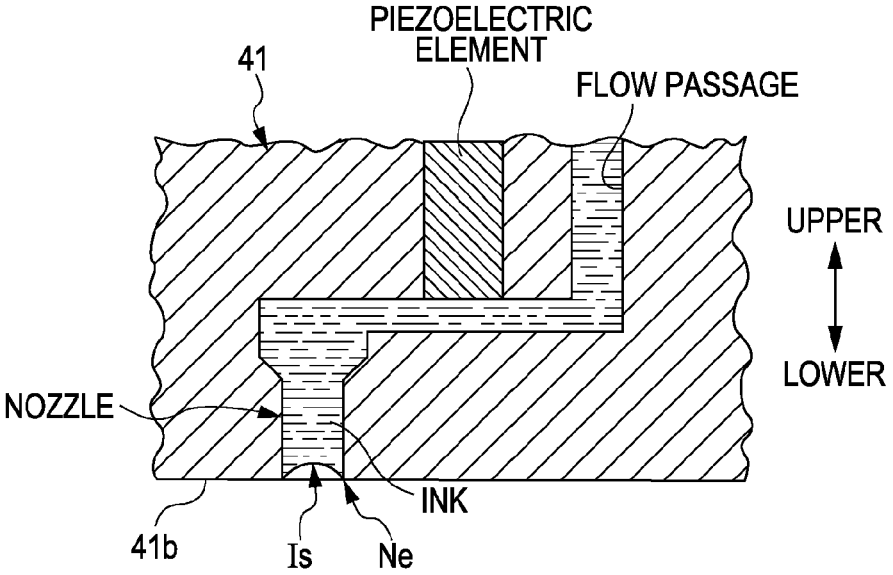

However, at each of the nozzle openings Ne at this time, there may be cases where a concave meniscus is not formed but a convex meniscus Is is formed, as shown in FIG. 12A. Here, unless the concave meniscus Is is formed, as shown in FIG. 12B, it is not possible to normally perform ink discharging operation in the printing process. For this reason, a wiping process is performed after finishing the ink return process. That is, using the wiper member 80 as shown in FIG. 6, the nozzle forming face of the lower face 41*a* of the recording head 41 is wiped, and thereby the meniscus of each of the nozzle openings Ne is formed into a concave shape, as shown in FIG. 12B. The wiper member 80 is, for example, an elastic plate that is formed by adhering a felt layer and a rubber layer together. The wiper member 80, as shown in FIG. 6, is provided below the recording head 41. The wiper member 80 is guided by a guide rail (not shown), or the like, so as to reciprocally move in the paper width direction. A driving mechanism (not shown) is also provided so as to reciprocally move the wiper member 80. Thus, as the wiper member 80 moves from a standby position on a side in the paper width direction to another standby position. During this movement, the upper end edge of the wiper member 80 contacts the nozzle forming face of the lower face 41*a* of the recording head 41 in order to wipe away the ink on the nozzle forming face. Thus, the meniscus of each of the nozzle openings Ne is formed into a concave shape. In this manner, the print head 41 returns to a state in which printing may be performed.

Figure 14:
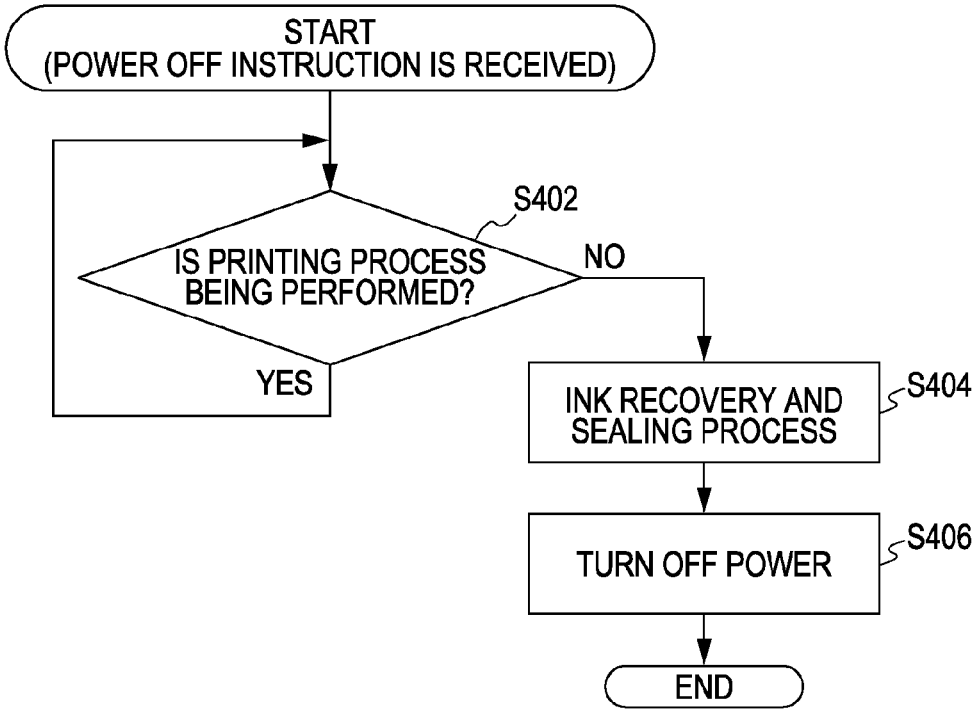
FIG. 14 is a flow chart of processes that are performed when the power is turned off.

Execution Timing of Ink Retraction and Sealing Process and Ink Recovery and Sealing Process FIG. 13 and FIG. 14 are views illustrating the execution timing of the ink retraction and sealing process and ink recovery and sealing process, and are flow charts of a series of processes that may be preformed from time when the power of the printer 1 is turned on to time when the power is turned off. FIG. 13 is a flow chart of processes that are performed after the power is turned on. FIG. 14 is a flow chart of processes that are performed after the power is turned off. Note that these processing flow charts are executed in such a manner that the CPU 62 of the controller 60 reads out programs corresponding to these processing flow charts from the memory 63 and then controls the above described various units, and the like, in accordance with the programs.

When a user presses a power button, the printer 1 is turned on. Then, in accordance with the above, as the controller 60 receives a power ON signal transmitted from the operating panel 66, the controller 60 starts the processing flow chart shown in FIG. 13 and then controls various units on the basis of the processing flow chart. Note that the processing flow chart shown in FIG. 13 is continuously executed until a power OFF instruction is received.

As shown in FIG. 13, as the controller 60 receives a power ON signal, the controller 60 initially performs the "ink return process" (S302) in order to prepare to discharge ink. Thus, ink in each ink tank 43 is filled up to the nozzle openings Ne of the recording head 41 (see FIG. 6). Note that the reason why the ink return process is performed at this time is because, during the time of power OFF, as described more fully below, the above described "ink recovery process" is performed, meaning that the nozzle openings Ne of the print head 41 are sealed by the flat plate member 79, and the insides of the flow passages of the recording head 41 and the insides of the supply tubes 45 are empty and the ink was removed, as shown in FIG. 10B. [0087] Next, the controller 60 proceeds to step 5304 and performs the "ink retraction and sealing process" in order to prevent the thickening of ink during a shortened print standby state. Thus, ink is drawn into the nozzle to a location inside the nozzle, and the print head 41 is moved to the print standby position P2 and the nozzle openings Ne are sealed by the flat plate member 79, as shown in FIG. 4 and FIG. 10A. Thereafter, the controller 60 proceeds to step 5306 and resets the timer 65, and then starts counting with the timer 65.

When the duration of the print standby state is likely to be long, the timer 65 switches the current ink retraction and sealing process to the ink recovery and sealing process in order to prevent evaporation and ink thickening when printing is stopped for a long period of time. Thus, in the next step 5308, the controller 60 compares the current count value T, which is counted by the timer 65, with a predetermined time limit Tth. When the count value T exceeds the predetermined time limit Tth, the process proceeds to the ink recovery and sealing process in step 5316. On the other hand, when the count value T does not exceed the predetermined time limit Tth, the process proceeds to step 5310, and then determines whether a print instruction regarding an unexecuted printing process has been received.

Then, when it is determined in step 5310 that the print instruction is not received, the process returns to step 5308 and then repeats comparison of the above described count value T. On the other hand, a print instruction is received, the process proceeds to the next step 5312. Then, in step 5312, the "ink reposition process" is performed. Thus, the print head 41 is moved from the print standby position P2 to the printing process position P1 in order to terminate the sealing of the nozzle openings Ne, and each ink surface Is is repositioned back into the nozzle opening Ne, thus entering a state in which ink droplets can be discharged, as shown in FIG. 8A.

Then, the process proceeds to step 5314 in order to perform a nozzle flushing process. During a nozzle flushing process, as well as the ink discharging operation of the normal printing process, ink droplets are driven from the nozzles by driving the piezoelectric elements. Thus, the ink surface Is in each nozzle is cleaned so as to be free from thickened ink. Incidentally, ink droplets that are discharged in the nozzle flushing process are received and held by the ink absorbent 26. The piezoelectric elements are not driven based on the print data during the print flushing operation, but based on the predetermined driving signals.

Then, the "printing process" (S322) is performed based on the print data corresponding to the print instruction. Because the printing process has been already described in FIG. 7, the description is omitted here. Then, as the printing process ends, the process returns to step S304 to perform the "ink retraction and sealing process" in order to return to the print standby state. After that, the timer 65 is started in step 5306. At step 5310, the printer 1 enters a standby state until a print instruction is received or the count value T exceeds the time limit Tth in step 5308.

Note that, in step 5308 in the print standby state, when the count value T of the timer 65 exceeds the time limit Tth at step 5308, the controller 60 proceeds to step S316 and performs the "ink recovery and sealing process", where the entire ink in the flow passages in the recording head 41 and in the supply tubes 45 is recovered into the ink tanks 43, and the nozzle openings Ne are sealed, as shown in FIG. 10B. Then, the controller 60 enters a standby state until a print instruction regarding an unexecuted printing process is received. When the controller 60 receives the print instruction (S318), the "ink return process" in step S320 is performed. In this manner, the print head 41 is moved from the print standby position P2 to the printing process position P1 in order to end the sealing of the nozzle openings Ne. Then the flow passages, or the like, of the recording head 41 are filled with ink, as shown in FIG. 6. After that, the process proceeds to step 5322 to perform the "printing process". Then, as the printing process ends, in order to suppress thickening of the ink during the print standby state, the process proceeds to the above described step 5304 to perform the "ink retraction and sealing process" where the previously described step 5306 and the following steps are repeated.

Incidentally, when the power of the printer 1 is turned off, a user presses the power button on the operating panel 66. In accordance with this pressing of the power button, a power OFF instruction is transmitted from the operating panel 66.

Then, when the controller 60 receives the power OFF instruction, the controller 60 starts the processing flow chart shown in FIG. 14.

That is, the controller 60 initially determines whether a printing process is being performed (S402). If it is determined that a printing process is being performed, the controller 60 waits until the printing process ends. Then, as the printing process ends, the processing flow chart shown in FIG. 13 is interrupted, that is, the process proceeds to step 5404 shown in FIG. 14 to perform the "ink recovery and sealing process". Thus, the ink in the flow passages of the recording head 41 and in the supply tubes 45 is recovered into the ink tanks 43, and the print head 41 is moved to the print standby position P2 to thereby seal the nozzle openings Ne by the flat plate member 79 (as shown in FIG. 10B. As a result, it is possible to prevent thickening of ink even when the printing process is not performed for a long period of time. Then, finally, the controller 60 turns off the power of the printer 1 (S406).

Other Embodiments

In the above embodiment, the invention is described with reference to a printing system 100. However, the printing system 100 is meant to be exemplary only, and the scope of the invention includes the disclosure of the liquid discharging apparatus and the method of discharging liquid. In addition, previously described embodiments do not intend to limit the scope of the invention. The aspects of the invention also include modifications and improvements without departing from the spirit of the invention and, of course, include the equivalents of them. Particularly, embodiments described below may also be included in the aspects of the invention.

In the above embodiment, the ink jet printer 1 is exemplified as the liquid discharging apparatus. However, aspects of the invention may be embodied as a liquid discharging apparatus that ejects or discharges a liquid other than ink, including a liquid body in which particles of functional material are dispersed, and a flowage body such as gel. For example, the liquid discharging apparatus may be a liquid body discharging apparatus that discharges a liquid body in which a material such as an electrode material or a color material, which is used for manufacturing a liquid crystal display, an EL (electroluminescence) display or a field emission display, is dispersed or dissolved, or may comprise a liquid discharging apparatus that discharges a bio-organic material used for manufacturing a bio-chip, or a liquid discharging apparatus that is used as a precision pipette and discharges a sample of liquid. Furthermore, the fluid discharging apparatus may be a liquid discharging apparatus that discharges a pinpoint of lubricating oil to a precision machine, such as a clock, watch, or camera. The invention may also comprise a liquid discharging apparatus that discharges a transparent resin liquid, such as an ultraviolet curing resin, for forming a microscopic semi-spherical lens (optical lens) used for an optical communication element, or the like, on a substrate. Furthermore, the invention may comprise a liquid discharging apparatus that discharges an etchant, such as acid or alkali, in order to perform etching on the substrate, or the like, or a flowage discharging apparatus that ejects a gel. Thus, the aspects of the invention may be applied to any one of these discharging apparatuses.

In the above embodiment, the invention is described as a line head printer 1, but the invention is not so limited. For example, the printer 1 may be a serial printer. That is, is the invention is applicable to a printer that includes a recording head in which a plurality of nozzles are arranged in a predetermined first direction, wherein the printer repeatedly performs an ink discharging operation in which, while the recording head is moving in a second direction that intersects with the first direction, ink is discharged from the nozzles toward a medium, such as a sheet of paper, to form dots and a transport operation in which the medium is transported in the first direction and, thereby, prints out an image on the medium.

Figure 15:
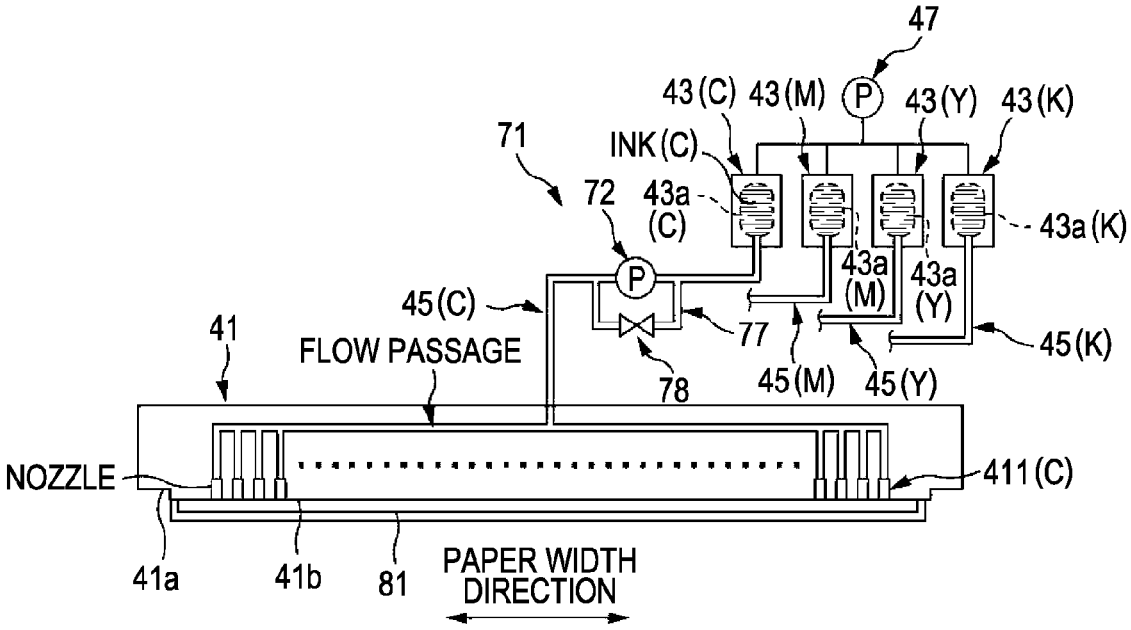
FIG. 15 is a view that illustrates an example in which a cap is used as a member that covers the nozzle openings.

In the above embodiment, the flat plate member is exemplified as a sealing member for sealing the nozzle openings Ne, however, the invention is not so limited. For example, the sealing member may comprise a substantially rectangular-parallelepiped-shaped box, with one open side that faces the nozzle forming face of the print head 41. [0099] In the above embodiment, the member that covers the openings of the nozzles using a flat plate member 79 that has the flat sealing face 79*a* that is brought into close contact with the flat nozzle forming face 41*b* of the print head 41, however, the member that covers the openings of the nozzles need not necessarily be brought into close contact with the nozzle forming face 41*b*. For example, the member that covers the openings of the nozzles may comprise a cap member having a bottom at one end such that when the cap member is brought into contact with the print head 41 to cover the nozzle openings Ne, the cap member may partially not seal the openings Ne of the print head 41. That is, when the cap member is brought into contact with the print head 41 to cover the nozzle openings Ne, the cap member adheres to the print head 41 in order to form a gap with a portion of region of the nozzle forming face. The cap member may also comprise a cap member 81 that covers the nozzle openings Ne, as shown in FIG. 15, so that the cap member 81 is not in surface contact with the nozzle forming face 41*b*. Even with the cap member 81 that covers the nozzle openings Ne, because the nozzle openings Ne are covered with the cap member, circulating air, or the like, that is generated in the space outside the nozzles does not reach the nozzles. As a result, it is possible to suppress evaporation of moisture from the surface of liquid.

In the above embodiment, as shown in FIG. 14, when a power OFF instruction is received, the "ink recovery and sealing process" is performed; however, the "ink retraction and sealing process" may be performed instead.

In the above embodiment, as shown in FIG. 13, at the time of the print 12, when the printer is in a print standby state, after the "ink retraction and sealing process" (S304) has been performed, the process proceeds to the "ink recovery and sealing process" (S316) after a time limit Tth has elapsed, but the invention is not so limited. The "ink recovery and sealing process" in 5316 may be immediately performed without performing the ink retraction and sealing process in 5304. That is, the steps from 5304 to 5314 may be omitted.

In the above embodiment, the "ink retraction and sealing process" and the "ink recovery and sealing process" are exemplified as the ink thickening prevention process; however, the present invention is not so limited. Moreover, the position of each ink surface (meniscus) Is is drawn is not limited. For example, ink may be drawn in to the non-discharge side of the nozzle so that each ink surface Is is located between the nozzles and the ink tanks 43, that is, ink may be drawn in to the non-discharge side so that the ink surfaces Is are located in the flow passages of the recording head 41 or in the supply tubes 45.

In the above embodiment, the tube pump 72 is exemplified as a pump that is used as part of the ink thickening prevention unit 70, however the invention is not so limited, so long as the pump is able to feed ink in both directions to the discharge side and to the non-discharge side in the supply tube 45. For example, a gear pump (a pump that feeds liquid using meshed rotating gears) may be used.

In the above embodiment, a piezoelectric element is used to discharge the liquid, however the invention is not so limited. For example, a thermal jet may be used which discharges liquid from nozzles using bubbles that are generated in the liquid when the liquid is heated.

In the above embodiment, ink in each ink tank 43 is pressure fed by the pressure pump 47. However, depending on the situation, the pressure pump 47 may be omitted. For example, when each ink tank 43 is located at a position higher than that of the recording head 41, because ink is supplied from each ink tank 43 to the recording head 41 by a difference in the water head between the recording head 41 and the tank 43, the pressure pump 47 may be omitted. [00106] In the above embodiment, the start-up timing and stop timing of each pressure pump 47 are not described, however, it is needless to say that the controller 60 starts up each pressure pump 47 on the basis of a power ON signal and the controller 60 stops each pressure pump 47 on the basis of a power OFF instruction.

In the above embodiment, ink is not described in detail, however, the ink is prepared in such a manner that an appropriate solvent, such as water, contains dissolved matter, such as dye, or solid matter, such as pigment, that is, dye ink, pigment ink, or the like, may be used.

What is claimed is:

1. A method of discharging liquid, comprising:

supplying liquid through a flow passage to a nozzle of a liquid discharging head which is connected to a tank which is capable of storing the liquid;

discharging the liquid from the nozzle of the liquid discharging head based on a data when in a power ON state, the nozzle being formed in a nozzle plate;

drawing the liquid in a second direction that is opposite to a first direction that the liquid is discharged from the nozzle, so as to form at least a space at a distal end portion of the nozzle when in a standby state wherein liquid is not being discharged from the nozzle based on the data or after a power OFF instruction has been received;

covering an opening of the nozzle with a member after the liquid has been drawn in the second direction, a surface of the member contacting the nozzle plate being flat; and recovering the liquid in the nozzle and the flow passage into the tank after covering the opening.

2. A method of discharging liquid, comprising:

supplying liquid through a flow passage to a nozzle of a liquid discharging head which is connected to a tank which is capable of storing the liquid;

discharging the liquid from the nozzle of the liquid discharging head based on a data when in a power ON state, the nozzle being formed in a nozzle plate;

drawing the liquid in a second direction that is opposite to a first direction that the liquid is discharged from the nozzle, so as to form at least a space at a distal end portion of the nozzle when in a standby state wherein liquid is not being discharged from the nozzle based on the data or after a power OFF instruction has been received;

covering an opening of the nozzle with a member after the liquid has been drawn in the second direction, a surface of the member contacting the nozzle plate being flat;

receiving a power OFF instruction; and recovering the liquid in the nozzle and the flow passage into the tank after receiving the power OFF instruction.

3. The method according to claim 1, wherein the liquid is ink.

4. The method according to claim 1, wherein when covering the opening of the nozzle with the member, the liquid discharging head is moved toward the member.

5. The method according to claim 4, wherein the member is fitted into a medium supporting unit which supports a medium.

6. The method according to claim 5, wherein the member is fitted downstream from a position of the liquid discharging head when the liquid discharging head discharges the liquid toward the medium in a medium transport direction.

7. The method according to claim 6, wherein when covering the opening of the nozzle with the member, the liquid discharging head is moved in the medium transport direction.

8. The method according to claim 1, wherein the member includes a flat plate member.

9. The method according to claim 1, further comprising;

releasing the covering of the opening before recovering the liquid.

10. The method according to claim 9, further comprising;

covering the opening after recovering the liquid.

* * * * *